United States Patent [19]

Matsui et al.

[11] Patent Number: 4,597,790

[45] Date of Patent: Jul. 1, 1986

[54] METHOD OF PRODUCING UNBAKED AGGLOMERATES

[75] Inventors: Seiji Matsui, Kawasaki; Kazuharu Yatsunami, Yokohama; Tsuneo Miyashita, Yokohama; Noboru Sakamoto, Yokohama, all of Japan

[73] Assignee: Nippon Kokan Kabushiki Kaisha, Tokyo, Japan

[21] Appl. No.: 736,329

[22] Filed: May 21, 1985

[30] Foreign Application Priority Data

May 30, 1984 [JP] Japan ..... 59-108662

[51] Int. Cl.[4] ..... C22B 1/08

[52] U.S. Cl. ..... 75/3; 75/5; 75/234; 75/235; 419/19; 419/23; 419/37; 419/38; 419/65; 419/66

[58] Field of Search ..... 75/3, 4, 5, 234, 235; 419/19, 23, 37, 38, 65, 66

[56] References Cited

U.S. PATENT DOCUMENTS

| | | | |
|---|---|---|---|
| 3,941,583 | 3/1976 | Martin et al. | 75/4 |
| 4,042,375 | 8/1977 | Martin et al. | 75/3 |
| 4,082,539 | 4/1978 | Sugawara | 75/3 |
| 4,350,523 | 9/1982 | Taguchi et al. | 75/5 |
| 4,402,736 | 9/1983 | Graham | 75/3 |
| 4,468,253 | 8/1984 | Tajima et al. | 75/3 |

*Primary Examiner*—Stephen J. Lechert, Jr.

*Attorney, Agent, or Firm*—Fleit, Jacobson, Cohn & Price

[57] ABSTRACT

In a method of producing unbaked agglomerates, green pellets or briquettes are produced by adding 5 to 30% of reduced iron powder, mill scale powder or iron sand and also adding a binder consisting of a cement or granulated blast furnace slag and then the green pellets or briquettes are dry cured thereby producing agglomerates having excellent reducing performance.

8 Claims, No Drawings

METHOD OF PRODUCING UNBAKED AGGLOMERATES

BACKGROUND OF THE INVENTION

The present invention relates to a method of producing unbaked agglomerates such as iron-making cold pellets or briquettes by using such raw material as iron ore fines, minus sieve or undersize baked pellet powder or dust powder produced in an iron work.

Generally, the production of unbaked agglomerates, e.g. cold pellets or briquettes for iron making is suited for the disposal of single-grade powder material such as iron ore fines or undersize powder produced during the baking of pellets or the disposal of a large amount of dust discharged from an iron works.

Such colds pellets, briquettes or the like must posses the desired handling strength as well as the desired strength during the gas reduction. Particularly, when used in a gas reducing furnace, it is essential that the material possesses a sufficient strength and has no danger of swelling during the reduction. In the process of reducing and melting the material at elevated temperatures as in the case of a blast furnace or an electric furnace for making pig iron, there is no difficult problem from the standpoint of strength since the material passes relatively quickly through a temperature region where its strength is decreased during the reduction and enters rapidly into a high temperature zone where the sintering takes place. Also, in the case of a shaft reducing furnace or the like, the material is reduced with a low-temperature high-reducing gas as compared with the blast furnace and moreover the product which is decreased in strength by the reduction is charged as such into the following-stage electric furnace. As a result, the unbaked agglomerates must have a sufficient strength to retain their shape during the time that they are handled.

The conventional unbaked agglomerates made by using only iron ore fines or undersize powder of baked pellets as a raw material are usually low in strength during and after the reduction. As a result, they are swollen and powdered in the gas reducing furnace and it is not possible to produce agglomerates having a sufficient strength for charging into the eletric furnace.

In other words, the cold bonded pellet process is suited for the agglomeration of iron ore fines or dust particles formed and recovered during the smelting and it is attracting notice as an energy saving process involving no environmental pollution since it requires no baking in contrast to the sintering process.

However, while, as regards the reduction of cold bonded pellets produced from raw materials of iron oxide types by the cold bonding process, no serious difficulty will be caused if the cold pellets reach a high temperature reducing zone in a relatively short period of time and the reduction proceeds as in the case of a large blast furnace, in the case of a gas reducing DR furnace (Midrex, Hyl, etc.) which performs the reduction at a relatively low temperature, there are many instances where the pellets are subjected, as incidental to the low temperature reduction, to swelling, reduction powdering, etc., and the resulting reduced iron (DRI) is not suited for use in the following smelting operation. This tendency becomes more marked as the reducing temperature is reduced and as the raw material used is higher in iron ore grade and of the hematite type.

As mentioned above, if the cold pellets produced from iron ore fines or undersize powder of baked pellets are reduced, reducing powdering and swelling of the pellets occur in a relatively low temperature range between 700 ® and 1000° C. and this tendency frequently occurs in the case of raw materials such as high quality hematites. This tendency is also marked in the case of reducing furnaces, particularly direct reducing furnaces where the reduction is performed by a highly reducing gas of a relatively low temperature.

SUMMARY OF THE INVENTION

It is the primary object of the present invention to provide a method of producing agglomerates so desired that in the production of cold pellets from undersize baked pellet powder or iron ore fines, 5 to 30% of a raw material consisting of direct gas reduced DRI powder or mill scale powder, iron sand or the like containing a large amount of metal iron or FeO is added thereby preventing the occurrence of reducing powdering, swelling, etc., of unbaked agglomerates.

In accordance with the invention, when cold pellets for use in direct reducing (DR) furnaces, mainly shaft reducing furnaces or the like are to be produced from such raw material as iron ore fines, baked pellet undersize ore or dust particles, a proper amount of reduced iron powder iron sand or mill scale is added to the raw material to increase the strength during the reduction and thereby prevent the occurrence of swelling and reducing powdering, and therefore the invention is usable in a wide range of applications including from smelting furnaces such as blast furnaces and electric furnaces to gas reducing furnaces for producing reduced iron.

DESCRIPTION OF THE INVENTION

Generally, when a raw material for blast furnace use, e.g., iron ore or baked pellets or a raw material for gas reducing purposes is reduced by the respective process, the strength of the material is decreased to a minimum in the temperature range between 700° and 900° C. Therefore, it does not necessarily follow that all of iron ores and baked pellets are usable irrespective of their grades and iron ores of considerably limited grades and good quality baked pellets must be used. The range of strengths obtained during reduction is as wide as from ten odd Kg/p to over 100 Kg/p and iron ores or baked pellets of the corresponding good qualities are required.

On the other hand, in the case of cold pellets produced from such nonblended raw material consisting of iron ore fines or baked pellet undersize powder, as the cold pellets are also increased in temperature and reduced, the strength is similarly decreased to a minimum in the range between 700° and 900° C. and the crushing strength of the material is on the order of 20 Kg/p as shown in the comparative example which will be described later. However, this crushing strength involves the possibility of a part of the pellets being powdered in large direct reducing furnaces and the pellets are suitable only for use in small direct reducing furnaces. Thus, there is a need for increasing the crushing strength and rotary strength during the reduction and the present invention has been made to meet this need.

The present invention consists in a method of producing unbaked agglomerates featuring that in the production of unbaked agglomerates such as cold bonded pellets or briquettes by using an iron oxide-type material as a raw material for unbaked agglomerates, 5 to 30% of one of the following materials is added to the raw material.

(1) Reduced iron powder containing 10% or more of metal iron.

(2) Mill scale powder, iron sand or the like containing 20% or more of FeO.

Then, a binder such as 5 to 15% by weight of a cement or 5 to 25% by weight of a granulated blast furnace slag is added to the above-mentioned composition and the thus produced green pellets or briquettes are subjected to predrying, steam curing and post drying or continuous curing in an atmosphere containing carbon dioxide gas and steam thereby producing unbaked agglomerates.

In accordance with the invention, the reason for adding 5 to 30% of the above-mentioned reduced iron powder, mill scale powder or iron sand to the raw material is that the addition of less than 5% deteriorates the reducing performance and the addition of over 30% deteriorates the after-reduction crushing strength.

The unbaked agglomerates produced in accordance with the invention can be used in a direct reducing furnace such as a shaft furnace without the occurrence of reducing powdering and swelling but maintaining the desired crushing strength and they can be used in a wide range of applications including not only smelting furnaces such as blast furnaces and electric furnaces but also gas reducing furnaces for producing reduced iron.

The following examples describe in greater detail the method of producing unbaked agglomerates according to the invention.

EXAMPLE 1

Green pellets were produced by using a raw material consisting of baked pellet undersize powder (T.Fe: 66.74 weight %, FeO: 4.24 weight %, $SiO_2$: 1.74 weight %, CaO: 1.82 weight %, $Al_2O_3$: 0.31 weight %; particle size distribution, +0.15 mm: 2.1%, 0.15~0.074 mm: 4.7%, 0.074~0.044 mm: 10.4%, −0.044 mm: 82.8%), adding to the raw material 10, 20 and 30%, respectively, of reduced iron (DRI) power (T.Fe: 67.76 weight %, M.Fe: 44.54 weight %, FeO: 28.38%, $SiO_2$: 9.46 weight %, CaO: 2.80%, $Al_2O_3$: 2.75 weight %; particle size distribution, +0.15 mm: 0.9%, 0.15~0.074 mm: 3.1%, 0.074~0.044 mm: 13.2%, −0.044 mm: 82.8%) and also adding 10% of a cement as a binder to the composition and then the geen pellets were subjected to operations of predrying (95° C.), steam curing and post drying (250° C.) in succession thereby producing unbaked product cold pellets.

In addition, using the above-mentioned baked pellet undersize powder in a nonblended form, cold pellets were produced by the above-mentioned method as a comparative example.

The reducing performances of these product cold pellets are shown in the following Table 1. As will be seen from Table 1, the performances were improved considerably by the respective additions of the reduced iron powder.

TABLE 1

| | Unit | Nonblended baked pellet undersize powder (comparative example) | Baked pellets + DRI powder 10% addition | 20% addition | 30% addition |
|---|---|---|---|---|---|
| Cold crushing strength | Kg/p | 267 Kg/p | 223 Kg/p | 270 Kg/p | 180 Kg/p |
| *JIS crushing strength after reduction | Kg/p | 19.1 Kg/p | 41.8 Kg/p | 41.2 Kg/p | 39.2 Kg/p |
| *JIS rotary strength after reduction | | | | | |
| + 10 mm | % | 84.9% | 96.9% | 96.4% | 98.6% |
| 10 − 5 | % | 0.8 | 0 | 0 | 0 |
| 5 − 3 | % | 0.1 | 0 | 0 | 0 |
| 3 − 1 | % | 0.1 | 0 | 0 | 0 |
| −1 | % | 14.1 | 3.1 | 3.6 | 1.4 |
| Total | % | 100.0 | 100.0 | 100.0 | 100.0 |

*JIS: Japan Industrial Standard

EXAMPLE 2

Green pellets were produced by adding 20% of DRI powder having the same properties as in Example 1 to iron powder fines (T.Fe: 68.32 weight %, FeO: 0.14 weight %, $SiO_2$: 0.28 weight %, CaO: 0.04 weight %, $Al_2O_3$: 0.73 weight %, MgO: 0.13 weight %, particle size distribution, +0.125 mm: 2.79%, 0.125~0.044 mm: 31.04%, −0.044 mm: 66.17%) and the green pellets were continuously formed into unbaked product cold pellets in an atmosphere containing carbon dioxide gas ($CO_2$: 25 vol. %, steam: 25 vol. %, 65° C.).

In addition, cold pellets were produced from the above-mentioned iron ore fines in a nonblended form as a comparative example and the reducing performances of these product pellets were as shown in the following Table 2.

TABLE 2

| | Unit | Nonblended iron ore fines (comparative example) | Iron ore fines with 20% DRI powder addition |
|---|---|---|---|
| Cold crushing strength | Kg/P | 153 Kg/p | 197 Kg/p |
| JIS crushing strength after reduction | Kg/p | 20.5 Kg/P | 36.2 Kg/p |
| JIS ratary strength | | | |
| + 10 mm | % | 84.7% | 96.4% |
| 10 − 5 | % | 0.3 | 0 |
| 5 − 3 | % | 0.1 | 0 |
| 3 − 1 | % | 0.1 | 0 |
| −1 | % | 14.8 | 3.6 |

TABLE 2-continued

| | Unit | Nonblended iron ore fines (comparative example) | Iron ore fines with 20% DRI powder addition |
|---|---|---|---|
| Total | % | 100.0% | 100.0% |

What is claimed:

1. A method of producing unbaked agglomerates in the form of cold bonded pellets or briquettes comprising the steps of:

adding a binder to an iron oxide-type raw material containing iron ore fines, baked pellet undersized powder or dust powder originating from iron works, producing green pellets or briquettes from said binder-added raw material, and drying and curing said green pellets or briquettes, wherein at least one selected from the group consisting of reduced iron powder containing 10 wt. percent or more of metal iron, mill scale powder containing 20 wt. percent or more of FeO, or iron sand containing 20 wt. percent or more of FeO is compounded to said raw material in an amount of 5–30 wt. percent of said raw material.

2. A method of producing unbaked agglomerates according to claim 1 wherein cement or granulated blast furnace slag is added as the binder.

3. A method of producing unbaked agglomerates according to claim 1 wherein said drying and curing step comprises pre-drying, then steam curing, and then post-drying.

4. A method of producing unbaked agglomerates according to claim 1 wherein said green pellets or briquettes are cured in an atmosphere containing carbon dioxide gas and steam.

5. A method for continuously producing unbaked agglomerates in the form of cold bonded pellets or briquettes, comprising the steps of compounding reduced iron powder containing 10 wt. percent or more of metal iron in an amount of 5–30 wt. percent of an iron oxide-type raw material containing iron ore fines, baked pellet undersized powder or dust powder originating from iron works to said raw material;

adding a binder to the foregoing compound;

producing green pellets or briquettes from said binder-added raw material;

pre-drying said green pellets or briquettes;

curing said green pellets or briquettes in an atmosphere containing steam; and post-drying said green pellets or briquettes.

6. A method of producing unbaked agglomerates according to claim 5, wherein said binder includes cement or granulated blast furnace slag.

7. A method of continuously producing unbaked agglomerates in the form of cold bonded pellets or briquettes, comprising the steps of compounding reduced iron powder containing 10 wt. percent or more of metal iron in an amount of 5–30 wt. percent of an iron oxide-type raw material containing iron ore fines, baked pellet undersized powder or dust powder originating from iron works to said raw material;

adding a binder to the foregoing compound;

producing green pellets or briquettes from said binder-added raw material; and curing said green pellets or briquettes in an atmosphere containing carbon dioxide gas and steam.

8. A method of producing unbaked agglomerates according to claim 7 wherein said binder includes cement or granulated blast furnace slag.

* * * * *